United States Patent [19]

Payne

[11] 4,071,110

[45] Jan. 31, 1978

[54] UNDERWATER VOICE COMMUNICATOR

[76] Inventor: Philip Wallace Payne, 157 Cocoa Ave., Indiatlantic, Fla. 32903

[21] Appl. No.: 724,349

[22] Filed: Sept. 17, 1976

[51] Int. Cl.[2] ..... G10K 9/10; G10K 11/02; A62B 7/02; H04R 25/00

[52] U.S. Cl. ..... 181/127; 179/107 BC; 179/1 UW; 128/141 A

[58] Field of Search ..... 181/127, 126, 149; 179/107 BC, 1 UW; 128/141 A, 142.4, 152, 151

[56] References Cited

U.S. PATENT DOCUMENTS

| | | | |
|---|---|---|---|
| 1,521,287 | 12/1924 | Gernsback | 181/127 |
| 3,174,129 | 3/1965 | Laughlin | 179/1 UW |
| 3,347,230 | 10/1967 | Cupp | 179/1 UW |

*Primary Examiner*—L. T. Hix
*Assistant Examiner*—Benjamin R. Fuller
*Attorney, Agent, or Firm*—Ralph B. Pastoriza

[57] ABSTRACT

The communicator comprises a casing with extending bits for clenching between a diver's teeth in a manner such that the diver can speak into an air chamber within the casing. An acoustical diaphragm within the casing absorbs acoustical energy in the air chamber. An emitter element in turn has at least one surface in direct physical contact with the surrounding water and is connected to the diaphragm through a mechanical means designed to provide an acoustical impedance match between the acoustic energy in the air chamber and the acoustic energy generated in the surrounding water by the emitter thereby maximizing the energy transfer from the diver's voice to the surrounding water. The casing and bit held in the diver's teeth serve as a receiver for acoustical energy in the water which is conducted through the bit and diver's teeth to his auditory senses.

8 Claims, 5 Drawing Figures

UNDERWATER VOICE COMMUNICATOR

This invention relates broadly to scuba (Self Contained Underwater Breathing Apparatus) equipment and more particularly to an improved underwater voice communicator which can be substituted for the normal mouthpiece provided with such scuba equipment.

BACKGROUND OF THE INVENTION

The use of Self Contained Underwater Breathing Apparatus by divers in carrying out a number of operations has greatly increased in recent years. Such operations may include spear fishing, photography and simple sightseeing as recreational activities. In other operations, divers can repair ship hulls, submerged machinery, piers, and pilings, as well as assist in petroleum drilling and extraction, laying and inspecting pipelines, and in placement of heavy underwater valves in sealed installations. Still other operations include harvesting of abalone, kelp and sea urchins commercially.

In all of the foregoing activities, it is common practice for divers to work in pairs. Thus, working together in a hazardous environment, they have a great need to be able to communicate observations, precautions and intentions one to the other.

In an effort to provide convenient underwater communication between divers, various underwater speaking devices have been proposed. Basically, these devices fall into two groups: first, mechanical devices wherein acoustical sound energy generated by the diver's voice is simply mechanically transferred to the surrounding water; second, electronic types in which either interconnecting wires, ultra sound electronically generated or electromagnetic radiation is utilized to carry the communication energy between transducers.

Unfortunately, such underwater speaking devices as have been provided to this date have not proved particularly satisfactory whether of the mechanical or electronic type. In the case of presently available mechanical speaking devices, there is an enormous loss in acoustic energy because of reflection when the energy transmission is attempted from air vibrations to vibrations in the water without means to match impedance. No prior art has been discovered which affords said matching. Thus a practical range for speaking with such mechanical devices has not, as a practical matter, been realizable. The electronic devices, on the other hand, while operable are relatively expensive and further are not often clear and distinct.

In general, it would be more desirable to provide a wholly mechanical type of underwater speaking device not only from the standpoint of economics but because if such a device could be provided to generate sufficient sound energy in the water, there is minimal loss in fidelity as compared to the electronic systems.

BRIEF DESCRIPTION OF THE PRESENT INVENTION

With the foregoing in mind, the present invention contemplates an underwater voice communicating device of the mechanical type thus having the advantage of being capable of manufacture for relatively little expense, and yet in which sufficient sound energy is generated in the surrounding water to provide communication over practical distances.

With respect to the foregoing, an important feature of the present invention is the provision of an underwater communicator wherein an acoustical impedance match is provided between acoustical energy generated by the diver's voice and the acoustical energy generated in the surrounding water for transmission to other divers in the area.

Briefly, in accord with the present invention, there is provided means defining an air chamber for communication with a diver's mouth so that the diver can speak directly into the chamber. This air chamber includes an acoustically responsive air diaphragm and an emitter means carried by the chamber having a sound emitting surface in direct physical contact with the surrounding water when the air chamber is submerged. A mechanical means physically connects the diaphragm and emitter to transfer acoustical energy from the diaphragm to the emitter in a manner to approach an optimum acoustical impedance match between acoustic energy generated by the diaphragm in the air chamber and acoustic energy generated in the surrounding water by the emitter means.

By approaching an optimum acoustical impedance match between air and water, the maximum energy transfer takes place with the result that for the first time an efficient and practical mechanical type underwater communicator results. BRIEF DESCRIPTION OF THE DRAWINGS A better understanding of this invention as well as many further features and advantages thereof will be had by now referring to the accompanying drawings in which.

DETAILED DESCRIPTION OF THE INVENTION

Figure 1:
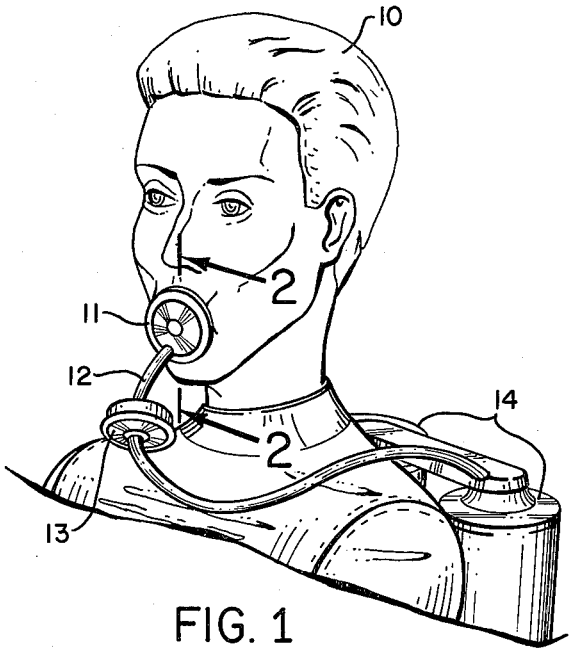
FIG. 1 is an illustration of a diver utilizing the underwater voice communicator of this invention in conjunction with scuba equipment normally worn by the diver.

Referring first to FIG. 1, there is shown a diver 10 holding the casing 11 of the underwater voice communicator of this invention in his mouth as a substitute for the normal mouthpiece for passing breathing air to the diver. In this respect, there is illustrated a connecting hose 12 from the normal air demand regulator 13 for passing breathing air from air supply tanks 14 directly through the casing 11 of the communicator. A feature of the present invention is thus the fact that the underwater communicator serves the additional function of the normal mouthpiece so that the diver can communicate and always have an appropriate air supply available for breathing, thus avoiding the problem of removing the normal mouthpiece to substitute therefor a voice communicator.

Figure 2:
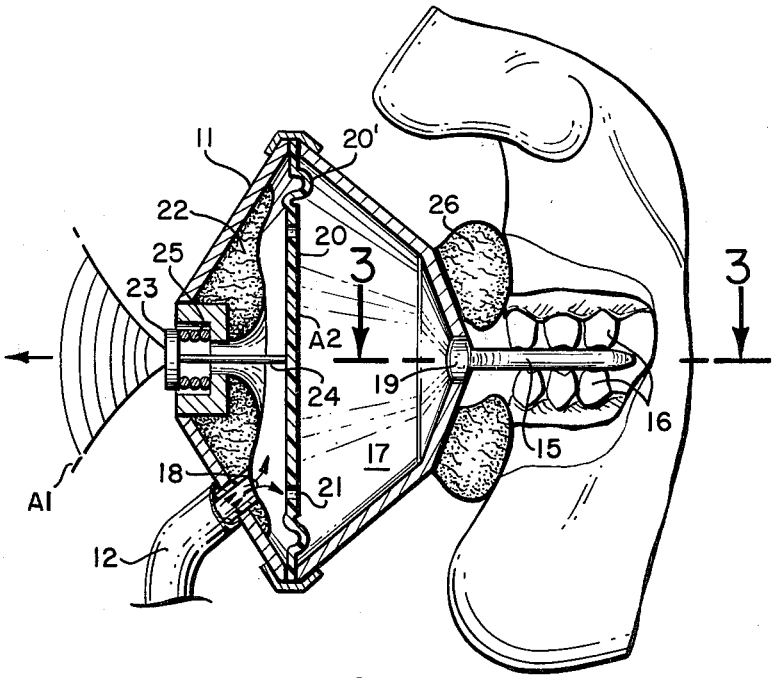
FIG. 2 is an enlarged fragmentary cross section of the voice communicator taken in the direction of the arrows 2—2 of FIG. 1.

With reference now to the enlarged fragmentary cross section of FIG. 2, details of the voice communicator will be evident. As shown, the casing 11 includes integrally extending means in the form of bits 15 which the diver 10 may clutch between his teeth 16 as indicated to support the casing 11 thereby avoiding the necessity of neck or head straps and the like. However, as will become clearer as the description proceeds, the clenching of the bit in the divers's teeth serves a more important function in that it enables the casing 11 to be utilized as a receiver of acoustical energy.

Still referring to FIG. 2, the casing 11 defines an air chamber 17 and further includes an air inlet passage 18 for connection to the air hose 12 from the demand regulator 13 as described in FIG. 1, and an air outlet opening 19 from the air chamber 17 adjacent to the integrally extending bit 15 for direct communication with the diver's mouth.

An acoustical diaphragm 20 is provided in the air chamber 17 and is responsive to the diver's voice to vibrate at voice frequencies. Small air holes or passages such as indicated at 21 may be provided to pass the breathing air provided from the hose 12 in the event the inlet air passage 18 is on the opposite side of the diaphragm as illustrated in the embodiment of FIG. 2. These small bypass holes or openings will not interfere with normal acoustical operation of the diaphragm.

In addition to the diaphragm 20, the interior wall of the casing 11 on the side of the diaphragm opposite the outlet opening 19 is provided with sound absorbing material 22 to minimize reflections of acoustic energy generated in the air chamber by movement of the diaphragm.

An emitter element 23 is shown in spaced opposed relationship to the diaphragm 20 with one surface in direct physical contact with the surrounding water when the casing 11 is submerged. In this respect, the periphery of the emitter element 23 is mounted to the casing by a thin annular flexible seal to prevent water from entering the casing so that the opposite side of the emitter facing the diaphragm 20 is exposed to the air chamber.

In the preferred embodiment of this invention which is illustrated in FIG. 2, there is provided a mechanical means interconnecting the diaphragm 20 and emitter 23 in a manner to provide an acoustic impedance match between acoustic energy generated by the user's voice in the air chamber 17 and absorbed by the diaphragm 20 and the acoustic energy generated in the surrounding water by the emitter 23. This mechanical means takes the form of a non-extensible line 24 which may be a thin fiber or thread connected between the center of the diaphragm 20 and the center of the emitter 23. In addition, there is provided a biasing means in the form of a spring 25 urging the emitter in a direction away from the diaphragm 20. In a similar manner, the diaphragm 20 itself is biased in a direction away from the emitter or towards the outlet opening 19 as by an annular leaf type folded spring arrangement 20' adjacent the periphery of the diaphragm. The nonextensible line 24 is thus always maintained in tension.

In the design of the diaphragm and emitter together with the various spring biasing arrangements as described to realize an acoustical impedance match, the area of the emitter 23 designated A1 is made less than the area of the diaphragm 20 indicated at A2. The density of the emitter element 23 itself is preferably 1.0; that is, substantially the same as water. The diaphragm 20 in turn is fabricated from a light organic paper or plastic type material such as employed in speaker cones.

Essentially, the described mechanical means functions to increase the force per unit area and decrease the amplitude of each acoustical vibration transferred from the diaphragm to the emitter by way of the non-extensible line 24 to an extent approaching an optimum acoustical impedance matching between the acoustical energy in the air chamber and the acoustical energy in the water all as will become clearer as the description proceeds.

In FIG. 2, there is shown at 26 an annular resilient sealing member disposed between the exterior of the casing surrounding the outlet opening 19 and the peripheral area of the diver's mouth. This member 26 functions to block water from entering the outlet opening and may constitute a sponge-like material which will not interfere with slight movements of the diver's lips in annunciating words.

As mentioned heretofore, the casing 11 not only serves to define the air chamber 17 but also functions as a receiver of acoustical energy generated in the water by other communicators in the area. This energy is conducted through the integrally extending bit 15 and diver's teeth 16 to his auditory senses, thus eliminating the necessity for earphones or helmets and the like.

Figure 3:
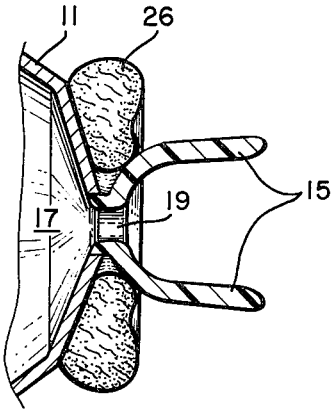
FIG. 3 is another fragmentary cross-sectional view looking in the direction of the arrows 3—3 of FIG. 2.

With respect to the foregoing, reference is had to FIG. 3 wherein it will be noted that the bit 15 is of a bifurcated shape to leave a wide central opening and thus not interfere with the diver annunciating words. The bit arms are sufficiently small in diameter that the diver can close his lips about the same when clenched in his teeth for the proper formation and annunciation of words.

Figure 4:
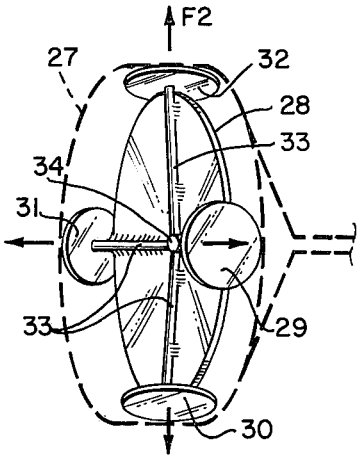
FIG. 4 is a diagramatic type illustration of a modified voice communicator in accord with the present invention; and, FIG. 5 illustrates a portion of the embodiment of FIG. 4 useful in explaining the operation thereof.

Referring now to FIG. 4, there is shown an alternative type of mechanical means for effecting the desired acoustic impedance match between the acoustic diaphragm and emitter means. In the showing of FIG. 4, a casing 27 defining an interior air chamber is provided, the casing being shown in phantom lines in order to expose the components within the air chamber. These components include an acoustic diaphragm 28 together with a plurality of emitters 29, 30, 31 and 32 positioned adjacent to equally circumferentially spaced peripheral points on the diaphragm. The mechanical means for providing the desired acoustical impedance match between the diaphragm 28 and various emitters comprises a plurality of radially extending non-compressible spokes 33 carried by the diaphragm and extending from the central area of the diaphragm wherein they may be loosely hinged or coupled as at 34, to pass through the points and connect to the emitters respectively. With this arrangement, vibrations of the diaphragm are communicated to the emitters through the medium of the spokes. As in the case of the mechanical means described in FIG. 2, the force per unit area applied to the diaphragm is amplified when transmitted to the emitters while the amplitude of vibration of the diaphragm is decreased at the emitters.

Figure 5:
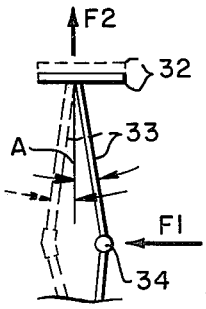

The foregoing can better be understood by referring to FIG. 5 wherein if F1 represents the force exerted on the diaphragm, this force is transmitted through the spoke 33 to the emitter 32 wherein it has been transferred to an increased force F2. If A represents the angle of the spoke 33 with respect to the vertical, then the force amplification is given by $F2=F1/\tan A$.

The four emitters in the embodiment described in FIG. 4 will all vibrate in unison to generate acoustic energy in the water surrounding the casing. FIG. 4 is merely illustrative of a lever type of mechanical means for effecting the desired impedance match. As a matter of simplicity and minimization of expense involved, the particular mechanical means described in FIG. 2 constitutes Applicant's preferred embodiment.

OPERATION

As described heretofore, the underwater voice communicator of this invention supplants the normal rubber mouthpiece of conventional scuba. The bit 15 is inserted into the diver's mouth and clenched between the teeth such that the circumferential seal about the mouth is brought sufficiently into compression to bar water intrusion, the annular sealing member 26 aiding in this respect. Moreover, the clenching of the bits by the diver's teeth serves, as described, to conduct sound vibrations picked up from the water by the shell of the casing to the teeth and thence to the diver's auditory senses. Breathing is accomplished as normal mouth respiration past the air diaphragm by way of the small openings 21 as described in FIG. 2.

The diver will speak with clenched teeth, articulating the lips around the bit to formulate, with a little practice, all the standard sounds of common speech.

With specific reference to FIG. 2, the voice energy in the air chamber 17 sets up differential pressures across the diaphragm 20. In response to these differential pressures, the diaphragm although restrained by the biasing arrangement 20' vibrates with little reflection and maximum absorption of the input acoustical energy. The vibration in turn generates acoustical energy in the air chamber as if the air diaphragm were somewhat "transparent" to sound energy. The acoustically absorbent material 22 on the opposite side of the diaphragm functions to prevent the reflection of damping energy back onto the diaphragm.

Proper "tuning" of the mechanical means for providing the desired acoustic impedance match is accomplished through selection of appropriate spring constants for the air diaphragm and the emitter spring 25. These spring constants are selected to deliver a substantial portion of the acoustical energy of the diver's speech to the water medium as audible underwater sound; that is, the adjustment is such as to optimize the acoustical impedance match between air and water.

In the embodiment of FIG. 4, the vibration of the diaphragm establishing acoustical energy in the air chamber for the casing 27 is transmitted to the several emitters through the medium of the spokes as described. In this latter embodiment, the stiffness of the diaphragm can be appropriately adjusted to limit the maximum extent of the angle "A" as described in FIG. 5 to optimize the acoustical impedance match.

From all of the foregoing, it will thus be seen that the present invention provides a vastly improved underwater voice communicator. Not only is sufficient sound generated in the surrounding water to render a mechanical type system wholly practical, but the system itself being of a wholly mechanical nature can be inexpensively manufactured. Moreover, and as described heretofore, the shell of the casing itself together with the bit serves as an acoustical receiver for acoustic energy generated by neighboring underwater voice communicators.

While only two specific examples of a mechanical means for effecting a desired impedance match have been disclosed in detail, it should be understood that equivalent lever type configurations functioning to essentially increase the force and decrease the amplitude of the air diaphragm vibrations at the emitter can be provided without departing from the scope and spirit of this invention.

What is claimed is:

1. An underwater voice communicator including, in combination:

a. means defining an air chamber for communication with a diver's mouth so that the diver can speak into said chamber;

b. an acoustically responsive air diaphragm in said chamber;

c. an emitter means carried by said air chamber and having a sound emitting surface in direct physical contact with the surrounding water when said air chamber is submerged; and, d. mechanical means physically connected to said diaphragm and emitter to transform acoustical energy from said diaphragm to said emitter in a manner to approach an acoustical impedance match between acoustic energy absorbed by said diaphragm in said air chamber and acoustic energy generated in the surrounding water by said emitter means.

2. An underwater voice communicator according to claim 1, including at least one extending bit from said means defining said air chamber which a diver may clench between his teeth for conducting acoustic energy in said surrounding water to the diver's auditory senses by way of his teeth.

3. An underwater communicator according to claim 1, in which said means defining an air chamber includes an air inlet passage for communication with the diver's air supply tanks so that air is available to said diver through said communicator.

4. An underwater voice communicator comprising, in combination:

a. a casing defining an air chamber and including integrally extending means which a diver may clench between his teeth to hold the casing in front of his mouth, said casing having an air inlet passage to said air chamber for communication with the diver's air supply tank and an air outlet opening from said air chamber adjacent to said integrally extending means for direct communication with the diver's mouth;

b. an acoustical diaphragm in said air chamber responsive to the diver's voice to vibrate at voice frequencies in said air chamber;

c. at least one emitter element supported by said casing with one surface in direct contact with the surrounding water when said casing is submerged; and, d. mechanical means physically connected to said diaphragm and emitter to transfer the acoustical energy in said diaphragm to said emitter, said mechanical means functioning to increase the force and decrease the amplitude of each acoustical vibration transferred from the diaphragm to the emitter in a manner to approach an optimum acoustical impedance match between acoustical energy generated in said air chamber by said diaphragm and the acoustical energy generated in the surrounding water by said emitter, said casing with said integrally extending means being responsive to acoustical energy generated in the surrounding water by similar underwater voice communicators to conduct the energy to the diver's teeth and thence through his teeth to his auditory senses whereby he can both transmit and receive acoustical voice messages while having air from his air supply tanks available for breathing.

5. An underwater voice communicator according to claim 4, in which said air chamber includes sound absorbing material on the interior wall of the casing on the opposite side of the diaphragm from said outlet opening.

6. An underwater voice communicator according to claim 4, including an annular resilient sealing member disposed between the exterior of said casing surrounding said outlet opening and the peripheral area of the diver's mouth to block water from entering said outlet opening.

7. An underwater voice communicator according to claim 4, in which said emitter is mounted on said casing in spaced opposed relationship to said diaphragm and is of smaller area than the area of said diaphragm, said mechanical means including a non-extensible line connected between the center of said diaphragm and the center of said emitter, said diaphragm being biased towards said outlet opening; and spring means biasing said emitter away from said diaphragm to place said non-extensible line in tension, the biasing forces exerted on said diaphragm and by said spring means being adjusted to optimize said acoustical impedance match.

8. An underwater voice communicator according to claim 4, in which there are provided a plurality of emitter elements positioned adjacent to equally circumferentially spaced peripheral points on said diaphragm, said mechanical means comprising a plurality of radially extending non-compressible spokes carried by said diaphragm and extending from a central area of said diaphragm to pass through said points and connect to said emitters respectively such that vibrations of said diaphragm are communicated to said emitters through the medium of said spokes.

* * * * *